US005768965A

United States Patent [19]

Gonzalez et al.

[11] Patent Number: 5,768,965

[45] Date of Patent: Jun. 23, 1998

[54] CASH DRAWER ASSEMBLY WITH CUTTER

[75] Inventors: Cesar A. Gonzalez, Lawrenceville; Dale R. Lyons, Suwanee, both of Ga.

[73] Assignee: NCR Corporation, Dayton, Ohio

[21] Appl. No.: 703,832

[22] Filed: Aug. 27, 1996

[51] Int. Cl.[6] ..... B26D 1/02

[52] U.S. Cl. ..... 83/440; 83/698.31; 83/856; 235/7 R

[58] Field of Search ..... 83/440, 698.31, 83/856; 30/336, 338, 339, 335, 340, 90.4, 92.5; 237/7 R

[56] References Cited

U.S. PATENT DOCUMENTS

| | | | |
|---|---|---|---|
| D. 42,619 | 6/1912 | Cress . | |
| 286,706 | 10/1883 | Kay . | |
| D. 308,811 | 6/1990 | Hochfeld et al. | D8/98 |
| D. 353,528 | 12/1994 | Glass | D8/98 |
| 909,145 | 1/1909 | Brunson . | |
| 1,246,905 | 11/1917 | Garlock . | |
| 1,727,648 | 9/1929 | Jarvis . | |
| 1,812,901 | 7/1931 | Rohner | 83/856 |
| 3,111,970 | 11/1963 | Priest et al. | 143/133 |
| 3,658,106 | 4/1972 | Elsasser | 146/106 |
| 4,001,934 | 1/1977 | Bell | 30/124 |
| 4,040,183 | 8/1977 | Cassier | 30/296 |
| 4,546,875 | 10/1985 | Zweber | 206/446 |
| 4,757,611 | 7/1988 | Tommi et al. | 30/2 |
| 4,825,738 | 5/1989 | Jones | 83/56 |
| 4,858,805 | 8/1989 | Hochfeld | 225/2 |
| 4,940,162 | 7/1990 | Thie | 221/129 |
| 5,097,733 | 3/1992 | Benkoski | 83/856 |
| 5,110,009 | 5/1992 | Gartner et al. | 221/266 |
| 5,123,320 | 6/1992 | Hochfeld | 83/856 |
| 5,448,833 | 9/1995 | Coon | 30/142 |
| 5,456,060 | 10/1995 | Tipp | 30/450 |
| 5,609,086 | 3/1997 | Addison et al. | 83/440 |

*Primary Examiner*—Maurina T. Rachuba
*Attorney, Agent, or Firm*—Francis L. Conte

[57] ABSTRACT

A cash drawer assembly includes a housing having a drawer slidably mounted therein which receives a till containing compartments for storing cash. A cutter in the form of a flat plate is removably trapped laterally between the till and the drawer, and includes a bottom edge abutting the drawer bottom, and a top edge positioned above the till for providing a cutting edge for opening a coin roll. The cutter is hidden when the drawer is closed, and is accessible when the drawer is open for convenient use.

20 Claims, 4 Drawing Sheets

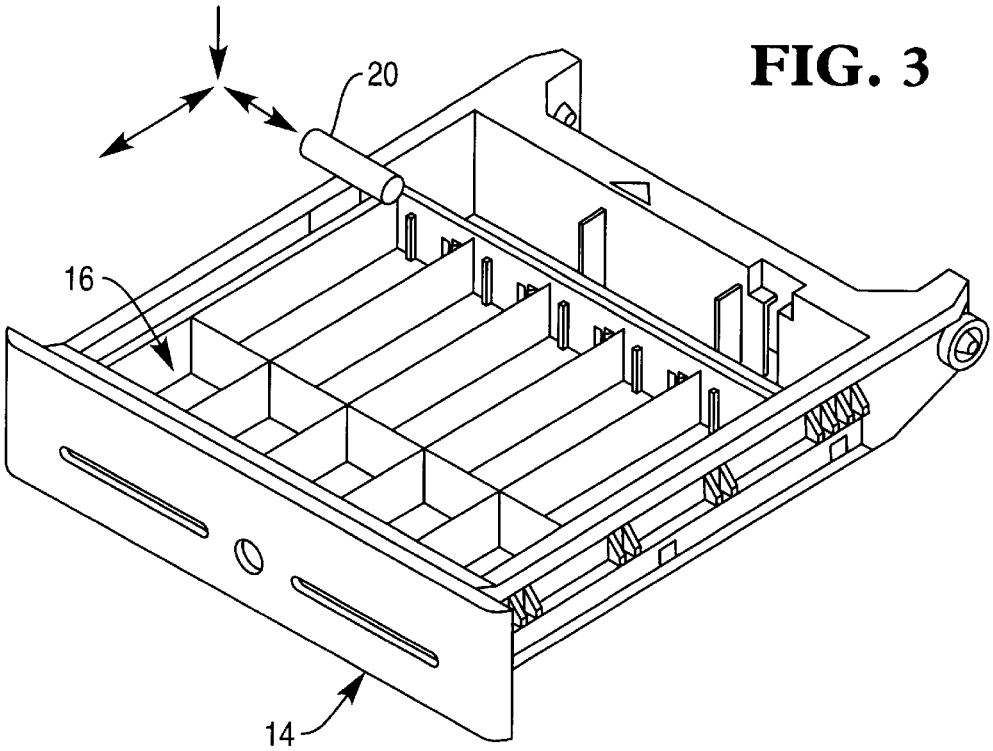
FIG. 3
FIG. 4
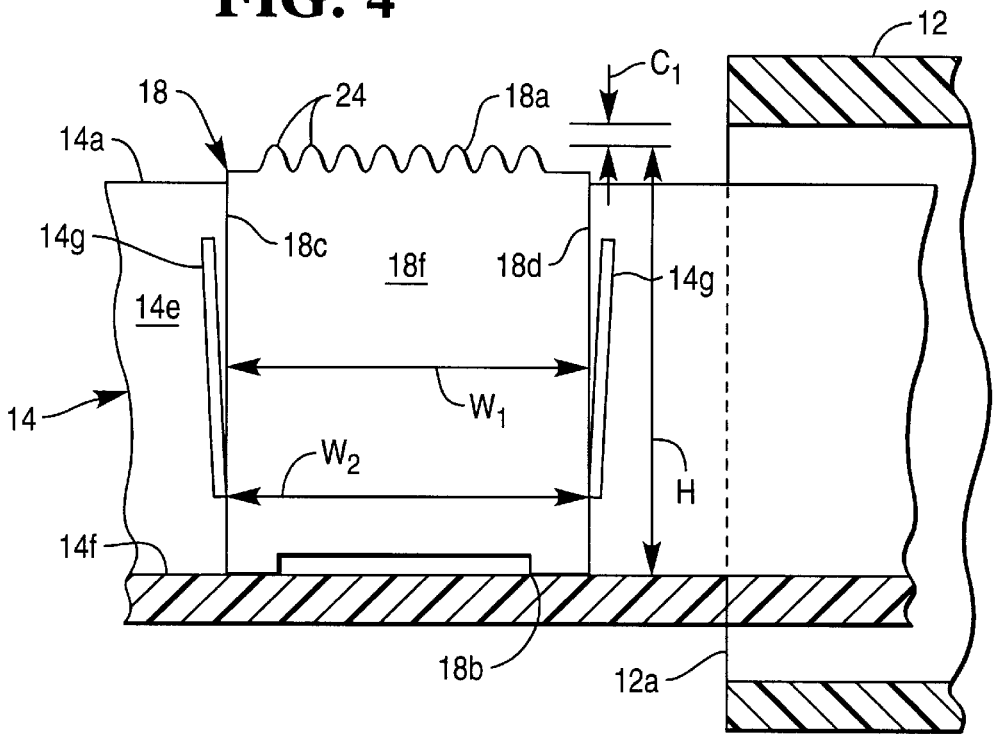

CASH DRAWER ASSEMBLY WITH CUTTER

BACKGROUND OF THE INVENTION

The present invention relates generally to cash drawers, and, more specifically, to opening of coin rolls for resupplying coins therein.

A typical cash drawer is an assembly of components including a housing with a front slot in which is slidably mounted a drawer. The drawer includes an upwardly facing cavity in which rests a tray or till which includes a plurality of compartments in which paper and coin currency are stored.

The cash drawer is part of a cash register used in commercial retail transactions. At the end of a typical transaction, the drawer is automatically opened to provide access to the till therein. And payment for a transaction is stored in the till, with change being provided as required.

When the coins in the till are depleted, additional coins must be resupplied. Coins are typically provided in the form of rolls bound together in a paper or plastic wrapping. The coin rolls are typically difficult to open, and they are usually opened by a clerk striking the roll against a rigid member for breaking open the roll. Since the till includes readily accessible partitions which define the currency compartments, it is common for a clerk to strike the coin rolls against the till partitions for opening the rolls. Since tills are typically formed of molded plastic, the repeated impact of the coin rolls against the plastic partitions eventually damages the till and requires replacement thereof at additional cost.

Various types of handheld openers are available for coin rolls which differ in configuration, function, and ease of use. These discrete openers may be lost or misplaced, and do not enjoy the ready accessibility of the till itself for opening coin rolls. It is therefore desirable to provide an improved cash drawer with an integral coin roll opener readily accessible therein.

SUMMARY OF THE INVENTION

A cash drawer assembly includes a housing having a drawer slidably mounted therein which receives a till containing compartments for storing cash. A cutter in the form of a flat plate is removably trapped laterally between the till and the drawer, and includes a bottom edge abutting the drawer bottom, and a top edge positioned above the till for providing a cutting edge for opening a coin roll. The cutter is hidden when the drawer is closed, and is accessible when the drawer is open for convenient use.

BRIEF DESCRIPTION OF THE DRAWING

The invention, in accordance with preferred and exemplary embodiments, together with further objects and advantages thereof, is more particularly described in the following detailed description taken in conjunction with the accompanying drawings in which:

FIG. 3 is an isometric view of the cutter, till, and drawer illustrated in FIG. 1 removed from the housing for clarity, and showing an exemplary coin roll being opened by the cutter.

FIG. 4 is an elevational, partly sectional view of a portion of the cash drawer illustrated in FIG. 1 and taken along line 4—4 showing an exemplary embodiment of the cutter mounted therein.

DESCRIPTION OF THE PREFERRED EMBODIMENT(S)

Figure 1:
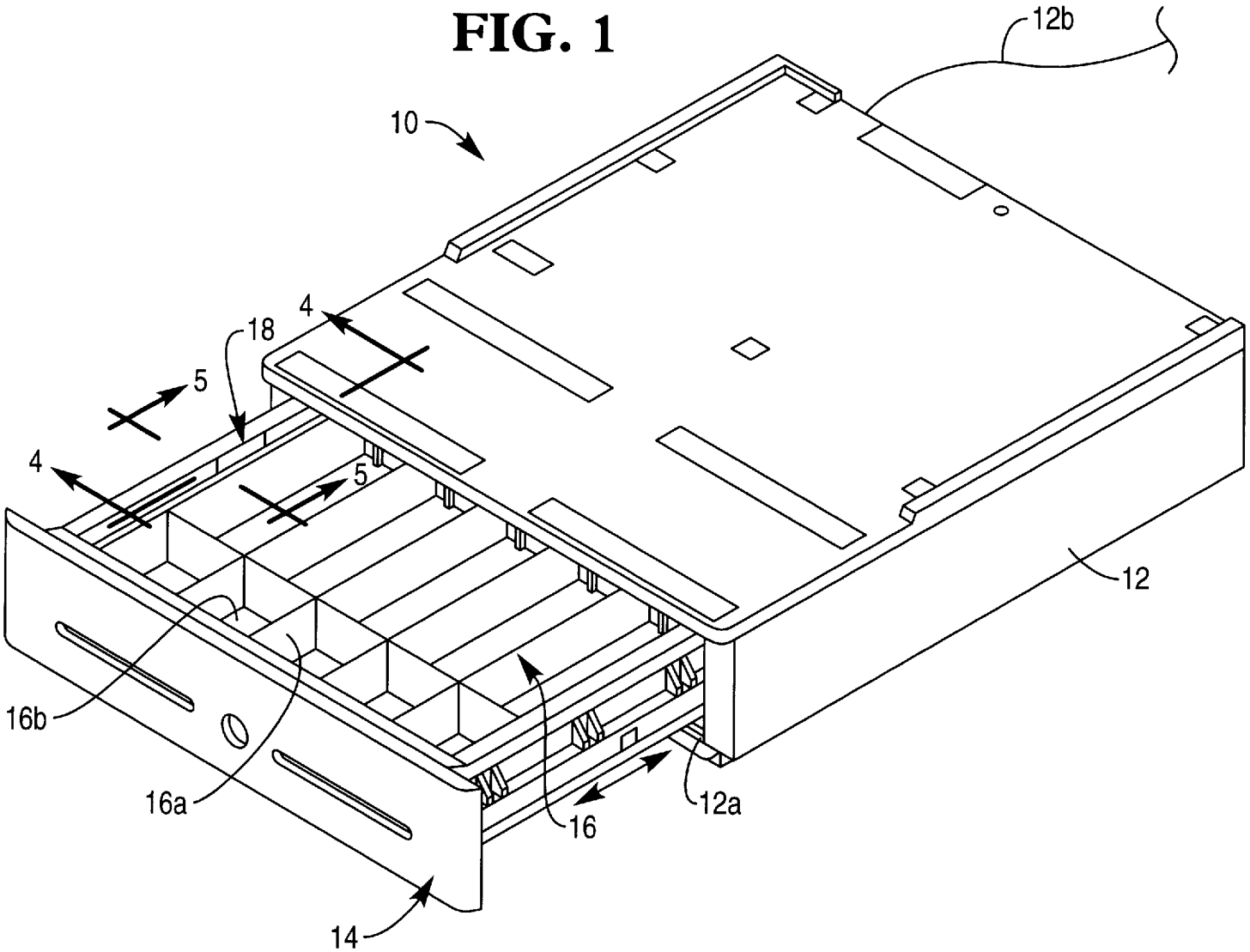
FIG. 1 is an isometric view of an exemplary cash drawer assembly in accordance with one embodiment of the present invention including a cutter trapped between a till and a drawer slidably mounted in a housing.
Figure 2:
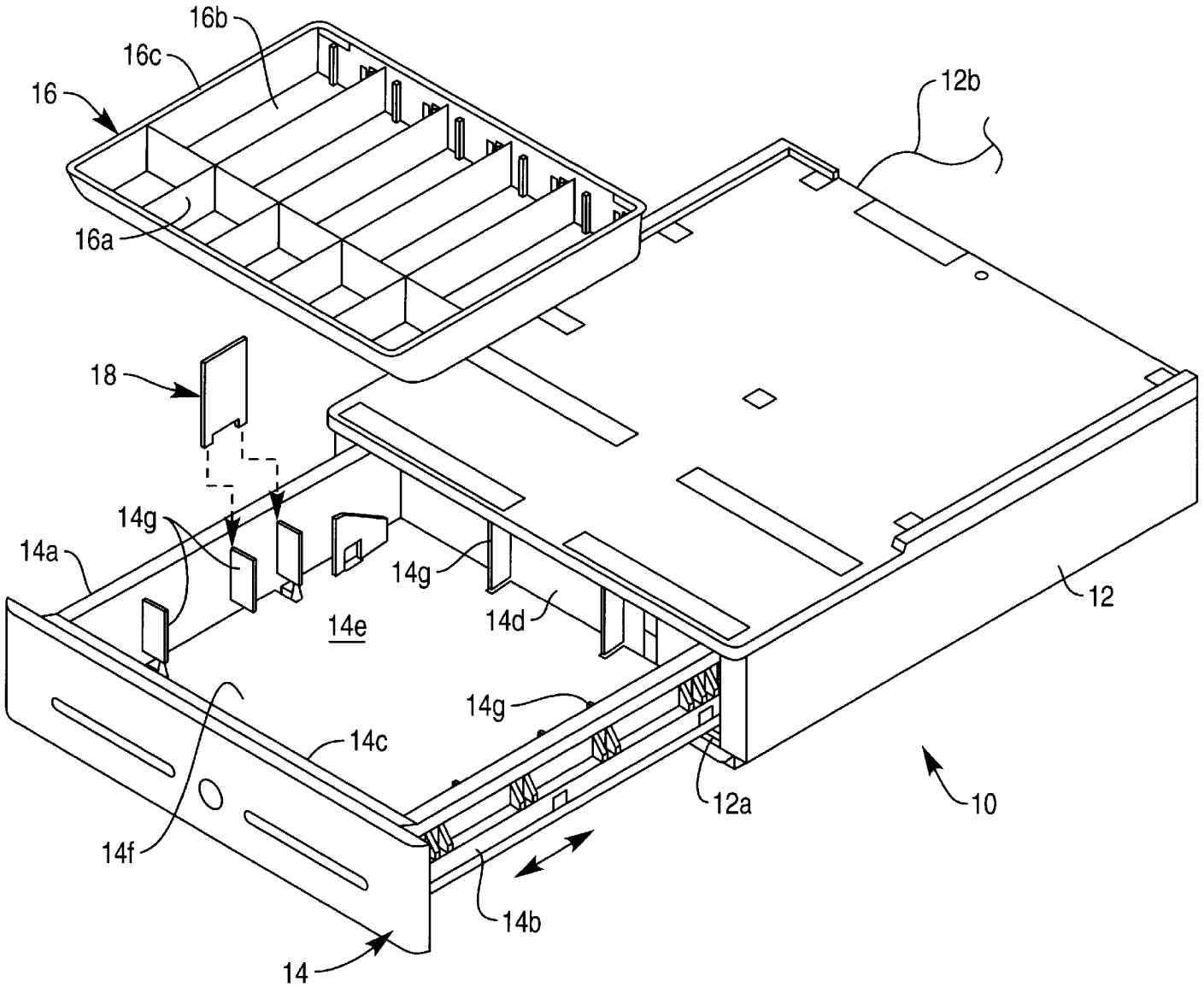
FIG. 2 is an exploded view of the cash drawer assembly illustrated in FIG. 2.

Illustrated in FIGS. 1 and 2 is an exemplary cash drawer assembly 10 in accordance with one embodiment of the present invention. The assembly 10 includes a generally rectangular housing 12 which is enclosed on all sides except for a front access slot 12*a*. A drawer 14 is suitably slidably mounted in the housing 12 through the front access slot 12*a*. As shown in more particularity in FIG. 2, the drawer 14 includes laterally spaced apart left and right walls 14*a* and 14*b*, and front and back walls 14*c* and 14*d* integrally joined together in a rectangle to define a drawer cavity 14*e* therebetween which opens upwardly from a closed flat bottom 14*f*.

A tray or till 16 removably sits in the drawer 14 and includes a plurality of partitions 16*a* defining a plurality of compartments 16*b* for storing cash in the form of paper bills and coins.

In the exemplary embodiment illustrated in FIG. 2, the drawer 14 also includes a plurality of vertically extending ribs 14*g*, which also extend laterally inwardly into the drawer cavity 14*e* for loosely supporting the till 16 which may be easily removed and replaced by simply lifting or lowering the till 16 as required.

The housing 12 includes an electrically operated latch (not shown) which is controlled by a suitable electrical lead 12*b* which extends to the controlling register (not shown) for opening the drawer 14 when required. The drawer 14 is initially spring loaded to partially open the drawer when the latch is released, with the drawer 14 then being manually pulled completely open for providing access to all compartments of the till 16. When a transaction is completed, the drawer 14 is manually pushed closed which reengages the latch and maintains the drawer 14 in its closed and locked position until it is reopened.

The cash drawer assembly 10 so described has been in widespread commercial use for a substantial number of years under the Class 2189 designation of the NCR Corporation. The drawer 14 and till 16 are typically plastic components for ease of manufacture and reduced cost. However, it is common in the industry to open coin rolls by hitting or impacting the coin roll against one of the till partitions 16*a* for breaking open the roll. Repeated use in this fashion often damages the plastic partitions 16*a*, which then requires replacement of the till 16 with the attendant cost therefor.

In accordance with the present invention, a specifically configured cutter 18 as shown in FIGS. 1 and 2 is provided in the drawer 14 for convenient use in opening coin rolls to prevent damage to the plastic till 16. Since the drawer 14 and till 16 are a preexisting design found in the industry, it is undesirable to make any changes thereto for incorporating the cutter 18 so that the cutter 18 may be readily retrofitted into existing equipment, without change.

In the exemplary embodiment illustrated in FIG. 2, the cutter 18 is in the form of a thin, rectangular flat plate formed preferably of metal such as galvanized steel instead of plastic for increasing its strength for use in opening coin rolls. The cutter 18 is specifically configured for operation with the existing drawer 14 and till 16 for providing an improved combination therewith enjoying various benefits as described hereinbelow.

The cutter 18 is illustrated in exploded view in FIG. 2. In FIG. 3 the cutter 18 is shown in its mounted position between the till 16 and the drawer 14, with an exemplary coin roll 20 being shown adjacent thereto for being opened thereby. FIG. 4 illustrates an elevational, side view of the cutter 18 mounted in the drawer 14. And, FIG. 5 illustrates a vertical end view of the cutter 18 mounted between the drawer 14 and the till 16.

As shown in more particularity in FIG. 4, the cutter 18 includes a top edge 18*a* spaced vertically above an opposite bottom edge 18*b*. Since the cutter 18 is in the exemplary form of a rectangle, it also includes spaced apart front and back edges 18*c* and 18*d*, with the four edges 18*a–d*generally defining a rectangular. Referring also to FIG. 5, the cutter 18 is a thin flat plate having a thickness T which is substantially less than its width $W_1$. The cutter 18 also includes left and right opposite flat sides 18*e* and 18*f*. The use of the terms left, right, front, and back in describing the drawer 14, till 16, and cutter 18 are merely illustrative of the embodiment illustrated in FIG. 2 relative to a typical user who would face forwardly towards the drawer 14.

Figure 5:
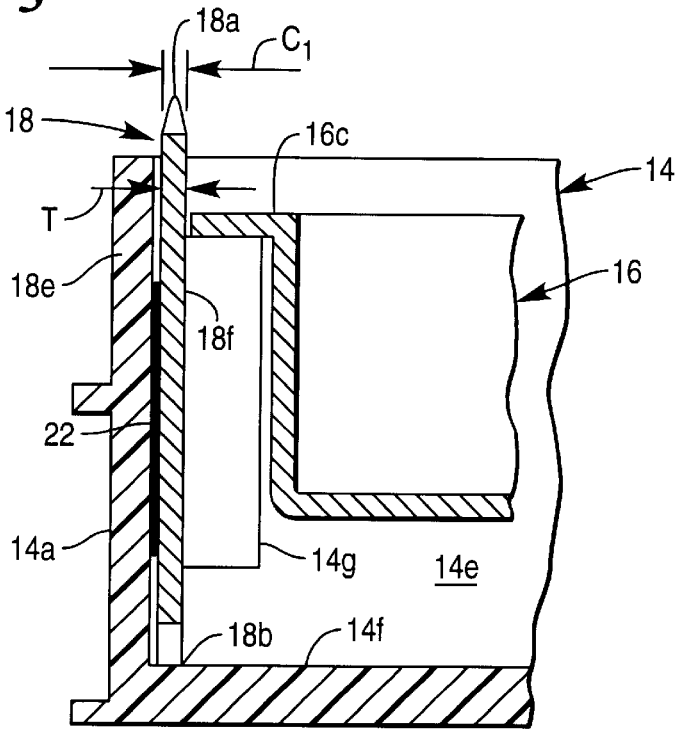
FIG. 5 is an elevational, partly sectional view of a portion of the cash drawer illustrated in FIG. 1 and taken along line 5—5 showing an exemplary embodiment of the cutter mounted therein.

As shown in FIGS. 4 and 5, the cutter 18 is configured for being removably trapped laterally between the till 16 and the drawer 14, with the bottom edge 18*b* abutting the drawer bottom 14*f*, and the top edge 18*a* being positioned vertically above the till 16 for providing a cutting edge for opening the coin roll 20. The cutter top edge 18*a* is accessible for either scoring the wrapper of the coin roll 20, or the coin roll 20 may be hit against the top edge 18*a*. Reaction loading from the coin roll 20 is therefore transferred directly through the cutter 18 and into the drawer bottom 14*f* at the abutting cutter bottom edge 18*b* in a rigid assembly.

As shown in FIG. 5, the till 16 has a perimeter flange 16*c* and is laterally narrower than the drawer 14 to define a till side clearance $C_1$ therebetween. The till flange 16*c* simply rests atop the drawer ribs 14*g*, and in the existing drawer design the lateral clearance $C_1$ is conveniently already provided. Accordingly, the cutter 18 is sized in thickness T to fit vertically through the till side clearance $C_1$ for laterally trapping the cutter 18 between the till 16 and the drawer 14. In an exemplary embodiment, the thickness T of the cutter 18 is about 125 mils to fit within the available side clearance $C_1$ in a close fit therein.

As illustrated in FIG. 2, the drawer ribs 14*g* are conveniently provided on the left, right, and back walls of the drawer 14 suitably spaced apart from each other. Since it is desirable to locate the cutter 18 in a remote, but accessible location, the existing ribs 14*g* are advantageously utilized. For example, three ribs 14*g* are provided on each of the left and right drawer walls 14*a,b* with two of the ribs being more closely spaced together closer to the back wall 14*d* of the drawer. Accordingly, the rear-most pair of vertically extending ribs 14*g* of either the left wall 14*a* or the right wall 14*b* may be used for conveniently mounting the cutter 18 without obstructing ready access to the various compartments of the till 16. The rear pair of ribs 14*g* extending inwardly from the left wall 14*a* are used in the exemplary embodiment illustrated in the Figures and are conveniently spaced apart front-to-back in the drawer 14 so that the flat cutter 18 may be correspondingly trapped therebetween. As shown in FIG. 4, the cutter 18 is disposed between the pair of ribs 14*g* and is sized in width $W_1$ for being trapped front-to-back therebetween to prevent movement in this direction.

As indicated above, this pair of ribs 14*g* and cutter 18 therebetween are preferably disposed closer to the back drawer wall 14*d* than to the front drawer wall 14*c* for stowing the cutter 18 out of the way when not needed. Access to the cutter 18 is made by ensuring the drawer 14 is fully open and the cutter 18 is exposed from inside the housing 12 wherein it is normally hidden along with the drawer 14 when closed or partially closed.

In order to ensure that the cutter 18 does not obstruct opening or closing of the drawer 14 within the housing 12 in normal operation, the cutter top edge 18*a* as illustrated in FIG. 4 defines a top clearance $C_2$ with the top of the housing slot 12*a* for allowing translation of the drawer 14 through the slot 12*a* without obstruction by the top edge of the cutter 18 itself. The cutter top edge 18*a* need only extend suitably above the till 16 and drawer 14 for being accessible to the coin roll 20, but should not be excessively high which would prevent opening and closing of the drawer 14.

Although the cutter 18 is effectively laterally trapped left-to-right between the drawer 14 and the till 16 and laterally trapped front-to-back between the adjacent ribs 14*g*, it is also desirable to provide further means for attaching the cutter 18 to the drawer 14 to ensure its adequate retention therein. In one embodiment, the attaching means include simply abutting the cutter 18 against both of the ribs 14*g* as illustrated in FIG. 4 in a friction or interference fit. Since the cutter 18 is preferably rectangular, the front and back edges 18*c,d* thereof extend vertically along the ribs 14*g* for support thereby.

In the exemplary embodiment illustrated in FIG. 4, the pair of preexisting ribs 14*g* are conveniently provided with a converging taper of a half degree each, with the bottom end of the ribs 14*g* being closer together at a spacing width $W_2$ than the top ends thereof. Since the ribs 14*g* are plastic, they have inherent elasticity, and therefore the width $W_1$ of the cutter 18 may be made slightly larger than the spacing width $W_2$ so that the cutter 18 may be forcefully inserted downwardly between the ribs 14*g* which slightly elastically spreads apart the lower ends of the ribs 14*g* for allowing the cutter 18 to be fully inserted with the bottom edge 18*b* abutting the drawer bottom 14*f*. In this way, the elastically deflected ribs 14*g* will provide a retention force on the cutter 18.

In an alternate embodiment illustrated in FIG. 5, the attaching means for the cutter 18 may include a conventional double-sided tape 22 disposed between the inside surface of the left drawer wall 14*a* and the left side 18*e* of the cutter 18, and adhesively joined thereto.

In an alternate embodiment, the cutter 18 may be screwed to the left drawer wall 14*a*. Or, the cutter 18 may include an enlarged center portion (not shown) for fully occupying the space between the left drawer wall 14*a* and the side of the till 16 as illustrated in FIG. 5 for allowing the till 16 to more fully entrap the cutter 18 when assembled. In these embodiments, the cutter 18 is initially inserted downwardly between the adjacent ribs 14*g* prior to assembly of the till 16 into the drawer 14, after which the till 16 entraps the cutter 18. Disassembly is readily accomplished by firstly removing the till 16 by lifting it out, and then simply removing the cutter 18 by also lifting it out.

In the exemplary embodiment of the cutter 18 illustrated in FIGS. 4 and 5, the cutter top edge 18*a* preferably extends almost completely between the cutter side edges 18*c,d* and is coplanar therewith in a common flat plate. Although the cutter top edge 18*a* in its simplest embodiment may be a square corner, it is preferred that the top edge 18*a* is in some form tapered together or converges outwardly away from the bottom edge 18*b*. For safety reasons, the cutter top edge 18*a* should not be so sharp as to cut skin, but should be suitably narrow to either score the wrapper of the coin roll 20, or allow impact breakage thereof against the top edge 18*a*. Accordingly, the cutter top edge 18*a* preferably includes an arcuate apex having a suitably small radius for opening the coin roll 20 without the ability for cutting skin if it is inadvertently touched by the user.

Figure 6:
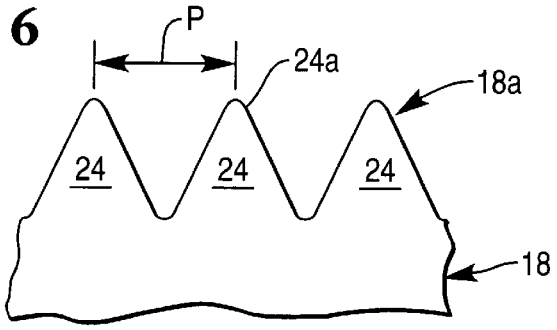
FIG. 6 is an enlarged, elevational view of the top cutting edge portion of the cutter illustrated in FIG. 4.

In a preferred embodiment illustrated in FIGS. 4 and 6, the cutter top edge 18*a* comprises a plurality of teeth 24 colinearly aligned between the cutter side edges 18*c,d*, with each of the teeth 24 having an arcuate apex 24*a* with a suitable radius of about 10 mils for example. The teeth 24 may be spaced apart at any suitable pitch p, such as for example 125 mils, which generally corresponds with the thickness T of the cutter 18 also being about 125 mils in this example.

A suitable number of the teeth 24 as illustrated in FIG. 4 are provided and extend for a minimum of about 1 inch so that the coin roll 20 may be scored in either a left-to-right direction or a front-to-back direction as shown by the double headed arrows in FIG. 3. Or, the coin roll 20 may be simply impacted vertically downwardly against the cutter top edge 18*a* for breaking open the roll 20. The width $W_1$ of the cutter 18 as illustrated in FIG. 4 may be any convenient value, and in the exemplary embodiment is sized to match the space width $W_2$ between the adjacent ribs 14*g* which is in the range of about 2–3 inches. And, the vertical height H of the cutter 18 may have any suitable value for allowing the cutter 18 to abut the drawer bottom 14*f* at its bottom edge 18*b*, with the top edge 18*a* being suitably elevated above the top of the till 16 and drawer 14 as required for providing access to the teeth 24 without obstructing closing of the drawer 14 through the housing access slot 12*a*.

Figure 7:
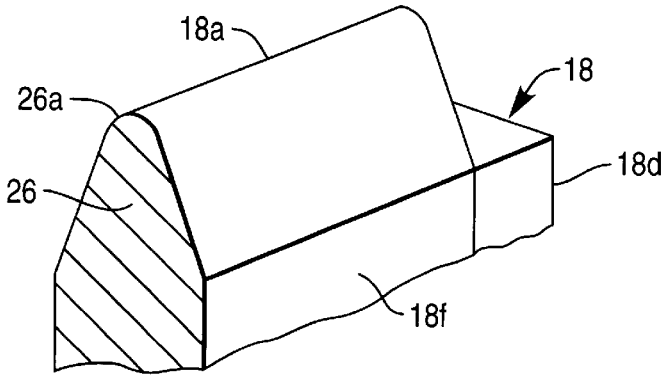
FIG. 7 is an isometric, partly sectional view of the top edge of the cutter illustrated in FIG. 4 in accordance with an alternate embodiment of the invention.

In an alternate embodiment of the cutter illustrated in FIG. 7, the cutter top edge 18*a* is defined by only a single elongate tooth 26 extending between the cutter sides 18*c,d* with a single corresponding apex 26*a* having a suitable radius of about 10 mils for example.

The cutter 18 described above is relatively simple in configuration and operation, and readily cooperates with the existing design of the drawer 14 and till 16 for providing an improved assembly thereof. The cutter 18 is automatically stowed away within the housing 12 when the drawer 14 is closed or only partially opened and thus prevents inadvertent contact therewith. When the cutter 18 is required, the drawer 14 is fully opened for allowing ready access thereto. The cutter 18 therefore does not interfere with normal operation of the drawer 14 when it is not required. And, the preferred configuration of the cutter top edge 18*a* prevents inadvertent injury to the user in the event of skin contact therewith since the edge is not sufficiently sharp for cutting skin, but is sufficiently effective for scoring or impacting the coin roll 20 for opening thereof.

The user may simply press the coin roll 20 on the cutter top edge 18*a* and move it back and forth either left-to-right or front-to-back for scoring the wrapper to open the roll. Or, vertical impact of the coin roll 20 against the cutter top edge 18*a* may be used for breaking open the roll 20. In the impacting mode of operation, reaction forces are carried through the cutter 18 directly into the drawer bottom 14*f*. If desired, the cutter bottom edge 18*b* may be provided with generally L-shaped feet for distributing the impact loads for reducing any concentration of stress at the drawer bottom 14*f*.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters patent of the United States is the invention as defined and differentiated in the following claims:

We claim:

1. A cash drawer assembly comprising:

a housing having an access slot;

a drawer slidably mounted in said housing through said access slot, and including left, right, front, and back walls integrally joined together in a rectangle to define a drawer cavity therebetween opening upwardly from a closed bottom;

a till removably sitting in said drawer, and including a plurality of compartments for storing cash; and a cutter in the form of a flat plate having spaced apart top and bottom edges, with said cutter being removably trapped laterally between said till and said drawer, with said bottom edge abutting said drawer bottom, and said top edge being positioned above said till for providing a cutting edge for opening a coin roll.

2. An assembly according to claim 1 wherein:

said till is laterally narrower than said drawer to define a till side clearance therebetween; and said cutter is sized in thickness to fit vertically through said till side clearance for laterally trapping said cutter between said till and drawer.

3. An assembly according to claim 2 wherein:

one of said left and right drawer walls includes a pair of vertically extending ribs spaced apart front-to-back in said drawer; and said cutter is disposed between said ribs and is sized in width for being trapped front-to-back therebetween.

4. An assembly according to claim 3 wherein said ribs and cutter therebetween are disposed closer to said back drawer wall than to said front drawer wall.

5. An assembly according to claim 3 wherein said cutter top edge defines a top clearance with said housing slot for allowing translation of said drawer through said slot without obstruction by said cutter.

6. An assembly according to claim 3 further comprising means for attaching said cutter to said drawer.

7. An assembly according to claim 6 wherein said cutter attaching means include abutting said cutter against both of said ribs in a friction fit.

8. An assembly according to claim 6 wherein said cutter attaching means include double-sided tape between said one drawer wall and said cutter.

9. An assembly according to claim 3 wherein said cutter is generally rectangular, and includes side edges extending vertically along said ribs for support thereby.

10. An assembly according to claim 9 wherein said cutter top edge extends between said cutter side edges and is coplanar therewith.

11. An assembly according to claim 10 wherein said cutter top edge is tapered.

12. An assembly according to claim 11 wherein said cutter top edge includes an arcuate apex.

13. An assembly according to claim 12 wherein said cutter top edge comprises a single elongate tooth extending between said cutter side edges.

14. An assembly according to claim 12 wherein said cutter top edge comprises a plurality of teeth aligned between said cutter side edges, with each of said teeth having an arcuate apex.

15. An assembly according to claim 14 wherein said ribs and cutter therebetween are disposed closer to said back drawer wall than to said front drawer wall.

16. An assembly according to claim 15 wherein said cutter top edge defines a top clearance with said housing slot for allowing translation of said drawer through said slot without obstruction by said cutter.

17. An assembly according to claim 16 further comprising means for attaching said cutter to said drawer.

18. An assembly according to claim 17 wherein said cutter attaching means include abutting said cutter against both of said ribs in a friction fit.

19. An assembly according to claim 18 wherein said till is plastic and said cutter is metal.

20. A cutter for being trapped between a till removably sitting in a drawer slidably mounted in a housing through an access slot, comprising:

a flat plate having spaced apart top and bottom edges and front and back side edges generally defining a rectangle;

said top edge including a plurality of teeth aligned between said front and back edges, with each of said teeth having an arcuate apex for providing a cutting edge for opening a coin roll; and said plate being sized for positioning said bottom edge in abutment with a bottom of said drawer, and with said top edge being positioned above said till so that said cutting edge is accessible.

* * * * *